United States Patent [19]

Rys-Sikora et al.

[11] 4,067,124

[45] Jan. 10, 1978

[54] PREVENTION OF COLOR MIGRATION IN SHOES

[75] Inventors: John Rys-Sikora, Bel Air; Reuben Abraham, Belcamp, both of Md.

[73] Assignee: Bata Shoe Company, Inc., Belcamp, Md.

[21] Appl. No.: 746,082

[22] Filed: Nov. 30, 1976

[51] Int. Cl.[2] ..... A43B 23/00; A43B 1/02; A43D 00/00

[52] U.S. Cl. ..... 36/45; 36/9 R; 12/146 C

[58] Field of Search ..... 36/114, 45, 83, 9 R; 12/142 R, 146 C, 142 P

[56] References Cited

U.S. PATENT DOCUMENTS

| | | | |
|---|---|---|---|
| 2,538,673 | 1/1951 | Donahue | 36/9 R |
| 2,995,839 | 8/1961 | Cronin | 36/9 R |
| 3,352,032 | 11/1967 | Yamaguchi | 36/9 R |

*Primary Examiner*—Patrick D. Lawson
*Attorney, Agent, or Firm*—Holman & Stern

[57] ABSTRACT

Shoes having dyed fabric uppers with elastomeric trimming bonded thereto are provided with an anti-color-migration coating on the portion of the fabric underlying the elastomeric trimming. The coating comprises a chlorinated rubber and a bleaching agent, such as sodium hypochlorite, and prevents discoloration of the elastomeric trimming due to migration of the dye from the fabric without adversely affecting the adhesion of the trimming to the fabric.

14 Claims, 2 Drawing Figures

PREVENTION OF COLOR MIGRATION IN SHOES

BACKGROUND OF THE INVENTION

This invention relates to shoes constructed of a dyed fabric upper and, more particularly, to the prevention of color migration from the dyed fabric to elastomeric trimming bonded thereto.

The manufacture of footwear constructed of a fabric upper, such as athletic shoes and the like, generally involves the bonding of various elastomeric trimming to a portion of the fabric. For example, the foxing and the toe cap of the shoe are typically formed of rubber or other elastomeric material which is bonded by adhesive or injection molding techniques to the fabric surface generally simultaneously with the attachment of the outsole to the lasted shoe upper. It is often aesthetically desirable to have the fabric upper dyed a relatively dark color and to employ white or other relatively light colored elastomeric trimming. However, the satisfactory use of this type of color combination has heretofore not been possible with certain synthetic fabrics whose exceptional durability makes them particularly suitable for use as shoe uppers but which do not possess a high degree of colorfastness. A fabric of this nature in present commercial use as a shoe upper material, for example, consists of a triblend of 60% polyester, 20% nylon and 20% cotton. Since dyed fabrics, of this type do not possess a high degree of color-fastness, light clored elastomeric trimming bonded to shoe uppers composed of such dyed fabrics tend to become discolored due to migration of the dye from the fabric. Moreover, previous attempts to treat the fabric in a effort to prevent the color migration have not proved to be satisfactory due to their adverse effects upon the subsequent adhesion of the elastomeric trimming to the fabric.

SUMMARY OF THE INVENTION

It is accordingly a primary object of the present invention to overcome the problem of color migration from the dyed fabric upper to the elastomeric trimming bonded thereto and the resulting discoloration of the trimming in shoes of the type described above.

Another object of the invention is to provide a method for overcoming the color migration problem in accordace with the preceding object which does not adversely affect the adhesion of the elastomeric trimming to the fabric.

A further object of the invention is to provide a method in accordance with the preceding object which enables white or otheer relatively light colored elastomeric trimming to be color-stably employed in combination with a relatively darkly dyed fabric upper composed of a fabric not having a high degree of colorfastness.

Still another object of the invention is to provide a method in accordance with the preceding objects which can bereadily and economically included as a step in conventional footwear manufacturing operations.

The above and other objects are achieved in accordance with the present invention by providing the dyed fabric upper with an anti-color-migration coating on the portion of the fabric underlying the elastomeric trimming. The anti-color-migration coating comprises a chlorinated rubber, such as chlorinated natural rubber or polychloroprene, and a bleaching agent for the dye used in dyeing the fabric. The bleaching agent is typically an oxidizing agent for the dye, such as sodium hypochlorite. The coating is applied onto the portion of the fabric which ultimately is to underlie the elastomeric trimming, in the form of a coating composition comprising the bleaching agent, the chlorinated rubber, and an organic solvent for the chlorinated rubber, such as toluol. Application of the coating composition to the fabric may be by conventional dip coating, brushing or mechanical application techniques. The solvent is then evaporated from the coated fabric, typically by air drying. Thereafter, the elastomeric trimming is bonded to the coated portion of the fabric by the usual adhesive bonding or injection molding techniques commonly employed in the manufacture of footwear of this type.

The anti-color-migration coating in accordance with the present invention effectively bleaches out the dye in the portion of the fabric which is to underlie the elastomeric trimming, thereby preventing the dye from discoloring the trimming by migrating from the fabric into the trimming. This enables white or other relatively light colored elastomeric trimming to be color-stably employed in combination with relatively darkly dyed fabric uppers made of a fabric not having a high degree of colorfastness, such as a blend of polyester, nylon and cotton. Moreover, the chlorinated rubber component of the coating provides the coated bleached fabric with a surface which is readily bondable to the elastomeric trimming by means of the conventional adhesive bonding or injection molding techniques, the coating in no way adversely affecting the adhesion of the elastomeric trimming to the fabric.

BRIEF DESCRIPTION OF THE DRAWINGS

The preferred embodiments of the present invention are hereinafter described with reference to the accompanying drawings, in which.

DESCRIPTION OF PREFERRED EMBODIMENTS

Figure 1:
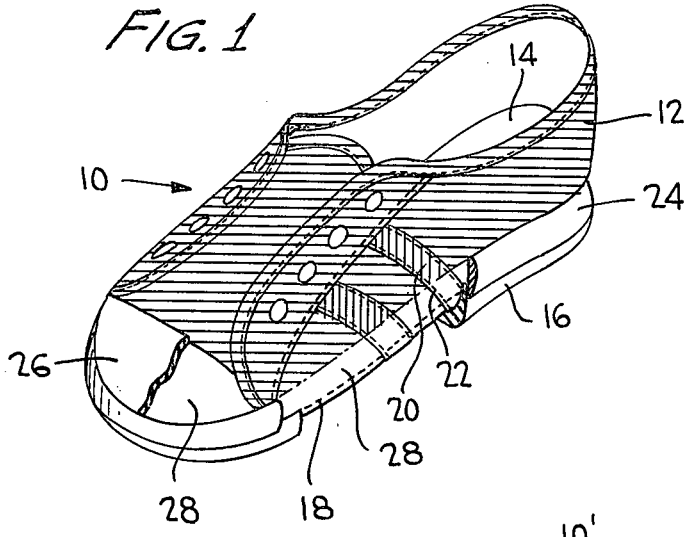
FIG. 1 is a perspective view of a shoe illustrating an embodiment of the present invention, with portions thereof cut away so as to show the underlying construction.

Referring now to FIG. 1 of the drawings, there is illustrated a completed shoe 10 in accordance with the present invention, composed of a dyed fabric upper 12, an insole 14, and a rubber outsole 16. As shown, the insole is lasted to the upper by means of stitching 18, and decorative or reinforcing strips 20, for example, of a contrastingly colored fabric, are attached to the upper by means of stitching 22.

While the upper 12 may be made of any of the fabrics conventionally employed in the manufacture of footwear of this type, the present invention is particularly applicable to those situations wherein the fabric is one not having a high degree of colorfastness. A specific example of this type of fabric is a blend of 60% polyester, 20% nylon and 20% cotton, whose high durability makes it particularly suitable for use in footwear but which lacks a high degree of colorfastness. In accordance with the present invention, this fabric may be used as the upper material and dyed a relatively dark color, for example, deep blue. The decorative or reinforcing strips 20 may suitably be made of the same fabric and will generally be of a contrasting color to provide a desired decorative effect. For purposes of more clearly illustrating the present invention, the decorative or reinforcing strips 20 are indicatted in the drawings as also being of a relatively dark or deep color, for example, red.

As is conventional with footwear of this type, the shoe 10 is trimmed with foxing 24 and a toe cap 26, such trimming being made of rubber or other elastomeric material bonded to the fabric upper 12. While such elastomeric trimming may suitably be of any desired color, the present invention is particularly applicable in those situations wherein either or both of the foxing 24 and the toe cap 26 are white or other color relatively light in comparison with that of the dyed fabric upper and thus particularly susceptible to discoloration due to migration of the dye from the fabric.

As indicated at the cutaway segments of the shoe illustrated in FIG. 1, the dyed fabric portions of the upper 12 and the decorative or reinforcing strips 20 which underlie the elastomeric foxing 24 and toe cap 26, are provided with an anti-color-migration coating 28. The coating 28 comprises a chlorinated rubber and a bleaching agent for the dye employed in dyeing the fabric. The chlorinated rubber component is preferably chlorinated natural rubber, but may also be a chlorinated synthetic rubber such as polychloroprene. The bleaching agent is typically an oxidizing agent for the dye, sodium hypochlorite being particularly suitable due to its relatively low cost. The amount of bleaching agent employed in the coating should be sufficient to effectively bleach out the color in the underlying dyed fabric, and will generally vary from 80 to 150 parts by weight per 100 parts by weight of the chlorinated rubber component, depending upon the particular bleaching agent employed and the color depth of the dyed fabric. For example, with a deep blue fabric, a suitable coating would be one containing 120 parts by weight of sodium hypochlorite per 100 parts by weight of chlorinated natural rubber.

The chlorinated rubber is an essential component of the coating 28 since without its presence, adequate adhesion of the elastomeric foxing 24 and toe cap 26 to the bleached fabric would be a problem. The chlorinated rubber component provides the coated bleached fabric with a surface which is readily bondable to the elastomeric trimming by conventional adhesive bonding or injection molding techniques. The coating 28 thus effectively prevents discoloration of the elastomeric trimming due to migration of the dye from the fabric without in any way adversely affecting the adhesion of the elastomeric trimming to the fabric, thereby enabling white or other relatively light colored elastomeric trimming to be color-stably employed in combination with relatively dark colored fabric uppers made of a dyed fabric not having a high degree of colorfastness.

The anti-color-migration coating in accordance with the present invention is applied to the dyed fabric in the form of a coating composition comprising the bleaching agent, the chlorinated rubber and an organic solvent for the chlorinated rubber. The organic solvent is preferably one which is highly volatile so that it can be readily and quickly evaporated from the coated fabric by air drying. A particularly suitable organic solvent meeting these requirements is toluol. The coating composition will generally contain, by weight, 100 to 120 parts of the organic solvent, 10 to 15 parts of the chlorinated rubber, and 12 to 15 parts of the bleaching agent. A specific example of a coating composition found to be particularly suitable for use with a dark blue fabric upper contains, by weight, 100 parts of toluol, 10 parts of chlorinated natural rubber, and 12 parts of sodium hypochlorite.

Figure 2:
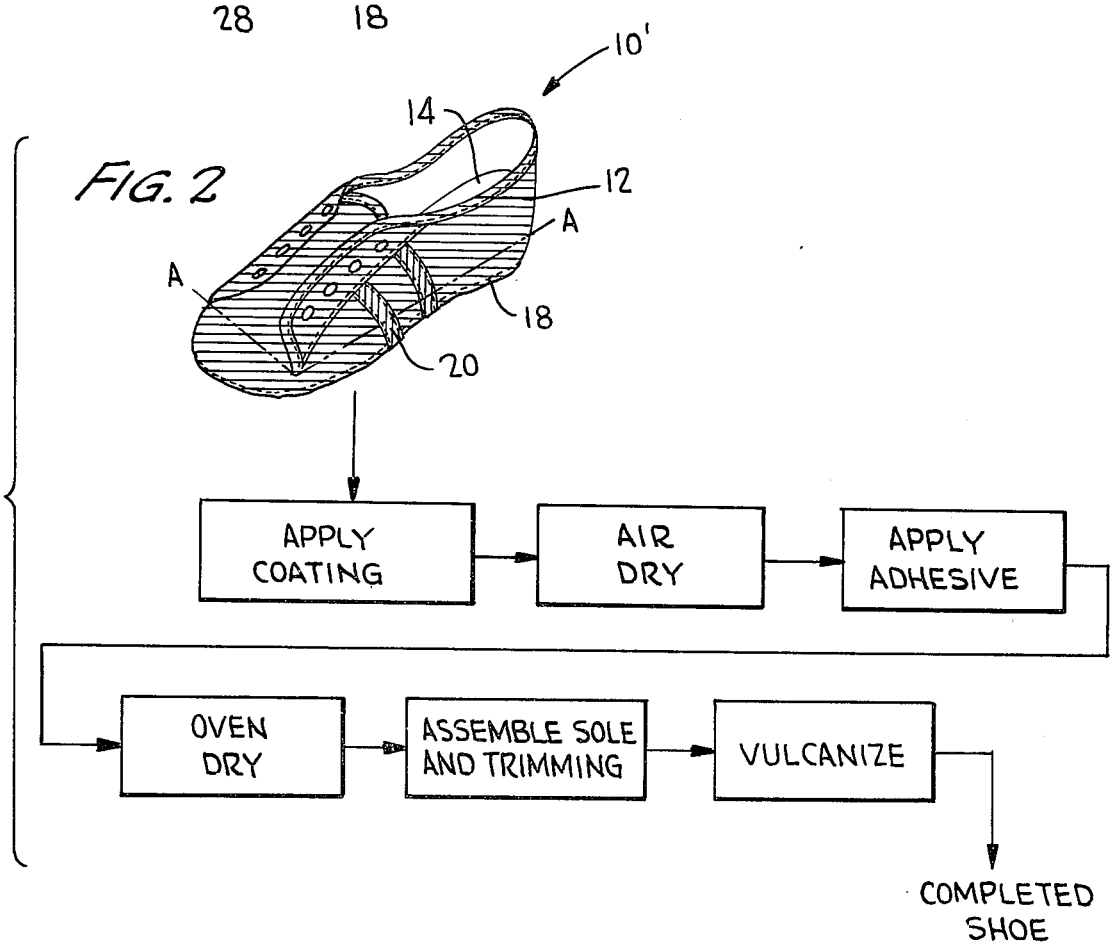
FIG. 2 is a diagramatic illustration of the sequence of steps involved in fabricating the shoe illustrated in FIG. 1 from a lasted shoe upper, employing the method of the present invention.

Referring now to FIG. 2 of the drawings, the coating composition containing the bleaching agent, the chlorinated rubber and the organic solvent is advantageously applied to the partially completed shoe 10' after the upper 12 with attached decorative or reinforcing strips 20 has been lasted to the insole 14. Application of the coating composition may suitably be effected by dip coating, brushing or mechanical application techniques. With an insole lasted shoe the dip coating procedure will generally be the most convenient. With a sock lasted shoe, on the other hand, the dip solution would penetrate the holes in the stitched-in sock, so that brush coating would be more suitable. In any event, the coating composition is applied to the dyed fabric portions of the partially completed shoe 10' which ultimately are to underlie the foxing and toe cap, as indicated by the broken line A—A in FIG. 2. The partially completed shoe is then air dried to effect evaporation of the organic solvent from the applied coating composition, leaving the coated portion of the fabric covered with the anti-color-migration coating 28.

Completion of the shoe is thereafter effected by the conventional techniques well known in the art, with the elastomeric foxing 24 and toe cap 26 being bonded to the coated portions of the fabric upper. Thus, for example, as shown in FIG. 2, a suitable rubber adhesive is applied over the coated portion of the fabric by dipping, brushing or mechanical application techniques, and thereafter oven dried. Any of the conventional latex or solvent adhesives commonly used for this purpose may be employed, since their effectiveness in adhering the elastomeric trimming to the fabric upper is in no way hindered by the anti-color-migration coating 28. An example of a suitable adhesive is a 60% natural or synthetic rubber latex emulsion containing 1% soap solution as an emulsifier and 0.1% ammonia as an anticoagulant. The rubber outsole 16, foxing 24 and toe cap 26 are then assembled in proper position for attachment to the upper 12, and thereafter subjected to vulcanization to effect the bonding together of the various parts into the completed shoe 10 illustrated in FIG. 1.

While the above-described procedure illustrated in FIG. 2 represents the preferred sequence of steps to be used in the fabrication of the completed shoe 10 illustrated in FIG. 1, it will be understood that various modifications of this procedure which will be apparent to those skilled in the art are contemplated as being within the spirit and scope of the present invention. For example, the appropriate portions of the fabric upper 12 could be provided with the anti-color-migration coating 28 when the upper is still in its flat form rather than after it has been lasted into the partially completed shoe 10' shown in FIG. 2. Also, the bonding of the elastomeric trimming to the coated bleached fabric could be effected by injection molding techniques rather than through an adhesive. Regardless of which of these fabrication procedures is employed, the presence of the anti-color-migration coating 28 between the elastomeric trimming and the dyed fabric will be effective to prevent discoloration of the elastomeric trimming due to migration of the dye from the fabric without adversely affecting the adhesion of the elastomeric trimming to the fabric.

The embodiments of the invention in which an exclusive property or privilege is claimed are defined as follows:

1. In a shoe comprising a dyed fabric upper provided with elastomeric trimming bonded thereto, the improvement whereby discoloration of said elastomeric trimming due to migration of the dye from said fabric is prevented without adversely affecting the adhesion of said elastomeric trimming to said fabric, said improvement consisting of an anti-color-migration coating on the portion of said fabric underlying said elastomeric trimming, said anti-color-migration coating comprising a chlorinated rubber and a bleaching agent for said dye.

2. The shoe in accordance with claim 1, wherein said chlorinated rubber is chlorinated natural rubber.

3. The shoe in accordance with claim 1, wherein said bleaching agent is an oxidizing agent for said dye.

4. The shoe in accordance with claim 1, wherein said bleaching agent is sodium hypochlorite.

5. The shoe in accordance with claim 1, wherein said fabric is a blend of polyester, nylon and cotton.

6. The shoe in accordance with claim 1, wherein said elastomeric trimming is of a lighter color than said dyed fabric.

7. The shoe in accordance with claim 1, wherein said anti-color-migration coating contains 80–150 parts by weight of said bleaching agent per 100 parts by weight of said chlorinated rubber.

8. In a method of manufacturing a shoe including the step of bonding elastomeric trimming to a dyed fabric upper, the improvement whereby discoloration of said elastomeric trimming due to migration of the dye from said fabric is prevented without adversely affecting the adhesion of said elastomeric trimming to said fabric, said improvement comprising the steps of applying onto the portion of said fabric which is to underlie said elastomeric trimming a coating composition comprising a chlorinated rubber, an organic solvent for said chlorinated rubber and a bleaching agent for said dye, evaporating the solvent from the coated fabric, and thereafter bonding said elastomeric trimming to the coated portion of said fabric.

9. The method in accordance with claim 8, wherein said chlorinated rubber is chlorinated natural rubber.

10. The method in accordance with claim 8, wherein said bleaching agent is an oxidizing agent for said dye.

11. The method in accordance with claim 8, wherein said bleaching agent is sodium hypochlorite.

12. The method in accordance with claim 8, wherein said organic solvent is toluol.

13. The method in accordance with claim 8, wherein said coating composition contains, by weight, 100–120 parts of said organic solvent, 10–15 parts of said chlorinated rubber, and 12–15 parts of said bleaching agent.

14. The method in accordance with claim 8, wherein the bonding of the elastomeric trimming to the fabric is effected through an adhesive applied to said coated portion of said fabric.

* * * * *